US009474360B2

(12) United States Patent
Alsalameh

(10) Patent No.: US 9,474,360 B2
(45) Date of Patent: Oct. 25, 2016

(54) LIQUID-DISPENSING SHAVING BRUSH

(71) Applicant: UMM AL-QURA UNIVERSITY, Makkah (SA)

(72) Inventor: Saleh Alsalameh, Qassim (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 149 days.

(21) Appl. No.: 14/218,880

(22) Filed: Mar. 18, 2014

(65) Prior Publication Data

US 2015/0265044 A1 Sep. 24, 2015

(51) Int. Cl.
*A46B 11/06* (2006.01)

(52) U.S. Cl.
CPC ..... *A46B 11/066* (2013.01); *A46B 2200/1033* (2013.01)

(58) Field of Classification Search
CPC ... A46B 11/06; A46B 11/063; A46B 11/066; A46B 2200/1033
USPC ..... 401/6, 40–42, 44–47, 188 R, 289
See application file for complete search history.

(56) References Cited

U.S. PATENT DOCUMENTS

| | | | | |
|---|---|---|---|---|
| 1,763,905 | A | 6/1930 | Rusell | |
| 2,358,252 | A | 9/1944 | Rowan | |
| 2,681,462 | A | 6/1954 | Turnes | |
| 2,764,772 | A | 10/1956 | Staskowski et al. | |
| 4,023,269 | A | 5/1977 | Lopez, Jr. | |
| 4,066,367 | A | 1/1978 | Sherosky | |
| 4,603,992 | A | 8/1986 | Kavoussi | |
| 4,813,138 | A | 3/1989 | Chen | |
| 4,974,264 | A * | 12/1990 | Brian | E03F 1/006 4/300 |
| 5,133,130 | A | 7/1992 | Podolsky | |
| 5,271,682 | A * | 12/1993 | Realdon | A47L 1/08 401/146 |
| 6,123,477 | A * | 9/2000 | Hecker | A46B 17/06 15/105 |
| 7,306,392 | B2 | 12/2007 | Mislove | |
| 7,670,073 | B2 * | 3/2010 | Fernschild | A46B 11/063 401/137 |
| 7,878,727 | B2 * | 2/2011 | Koptis | A46B 7/02 401/123 |
| 2012/0124758 | A1 | 5/2012 | Sabisch et al. | |

* cited by examiner

*Primary Examiner* — Mark A Laurenzi
*Assistant Examiner* — Joshua Wiljanen
(74) *Attorney, Agent, or Firm* — Richard C. Litman

(57) ABSTRACT

The liquid-dispensing shaving brush includes a number of embodiments that provide for dispensing water from the head of the brush and through the fibers or bristles of the brush. Some embodiments provide for connection to a water tap, and a hand control on the brush or a remote foot control providing for control of water flow. Other embodiments provide a portable container for water, permitting use when a source of running water is not available. The portable container may be pressurized, and flow may be controlled either by the hand-operated valve on the brush handle, or by a remote foot control. Still other embodiments are self-contained, with a liquid supply contained within the handle. All embodiments may include a hollow brush handle volume for containment of liquefied shaving soap or cream therein, and an openable brush head or cap providing access for refilling the brush handle volume as needed.

6 Claims, 13 Drawing Sheets

LIQUID-DISPENSING SHAVING BRUSH

BACKGROUND OF THE INVENTION

1. Field of the Invention

The present invention relates to personal hygiene and grooming aids, and particularly to a liquid-dispensing shaving brush capable of dispensing water from various sources for moistening the beard for shaving.

2. Description of the Related Art

Innumerable innovations in personal grooming and shaving have been developed over the years, from the straight razor and shaving soap to the modern multiple blade safety razor and pressurized container of shaving cream, or the electric razor for those who prefer such devices. However, many persons prefer a middle ground in such technology, using a shaving brush to apply lather to the face or other area to be shaved and then using a razor of some sort for shaving. As a result, a number of devices for dispensing lather or shaving cream and the like, including shaving brushes, have been developed in the past. While most all such devices perform an adequate job of dispensing shaving cream or lather, very few, if any, are also capable of providing a constant flow of water, either from the brush, or particularly from an external source of water, either a tap or portable container. Moreover, most such devices tend to be rather cumbersome to use, as the user must manipulate the brush and simultaneously control the flow of water or lather with one hand.

Thus, a liquid-dispensing shaving brush solving the aforementioned problems is desired.

SUMMARY OF THE INVENTION

The liquid-dispensing shaving brush includes a number of different embodiments that provide for a flow of water through the brush to assist in moistening and wetting the beard and skin while applying shaving soap or lather. Certain embodiments are adapted for connection to a water tap, and enable the user to open the tap and control the flow of water by means of another control associated with the liquid dispensing shaving brush. One such embodiment includes a water control disposed in the handle of the brush for convenient manipulation by the user. Another related embodiment places the control remotely on the floor or other surface, so that the user controls the water flow by means of his foot.

The liquid-dispensing shaving brush also includes embodiments that provide for liquid dispensing when no source of continuously running water is available, e.g., in remote locations without plumbing or a water supply. These embodiments provide a water container that may be pressurized by the user to provide the required flow of water. The water flow from the container may be controlled by a foot-operated valve, in the manner of another embodiment noted generally further above. Various embodiments include a brush handle having an internal volume for containing a shaving lather or liquid soap. Access to the internal volume is provided by a hinged brush head. This construction enables the user to fill the internal volume of the brush handle with shaving lather or soap.

Other embodiments include a manually operated mechanical or pneumatic pump in the handle or between the handle and the brush. Either the brush may be removed from the handle, or a cap may be provided at the end of the handle opposite the brush to allow the hollow handle to be filled with water and/or other liquid. The pump is used to pressurize the interior of the handle and thereby expel the liquid contained within the handle from the brush as desired. Alternatively, an electrically powered pump may be provided for these and any of the other embodiments of the present invention that employ a pump.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
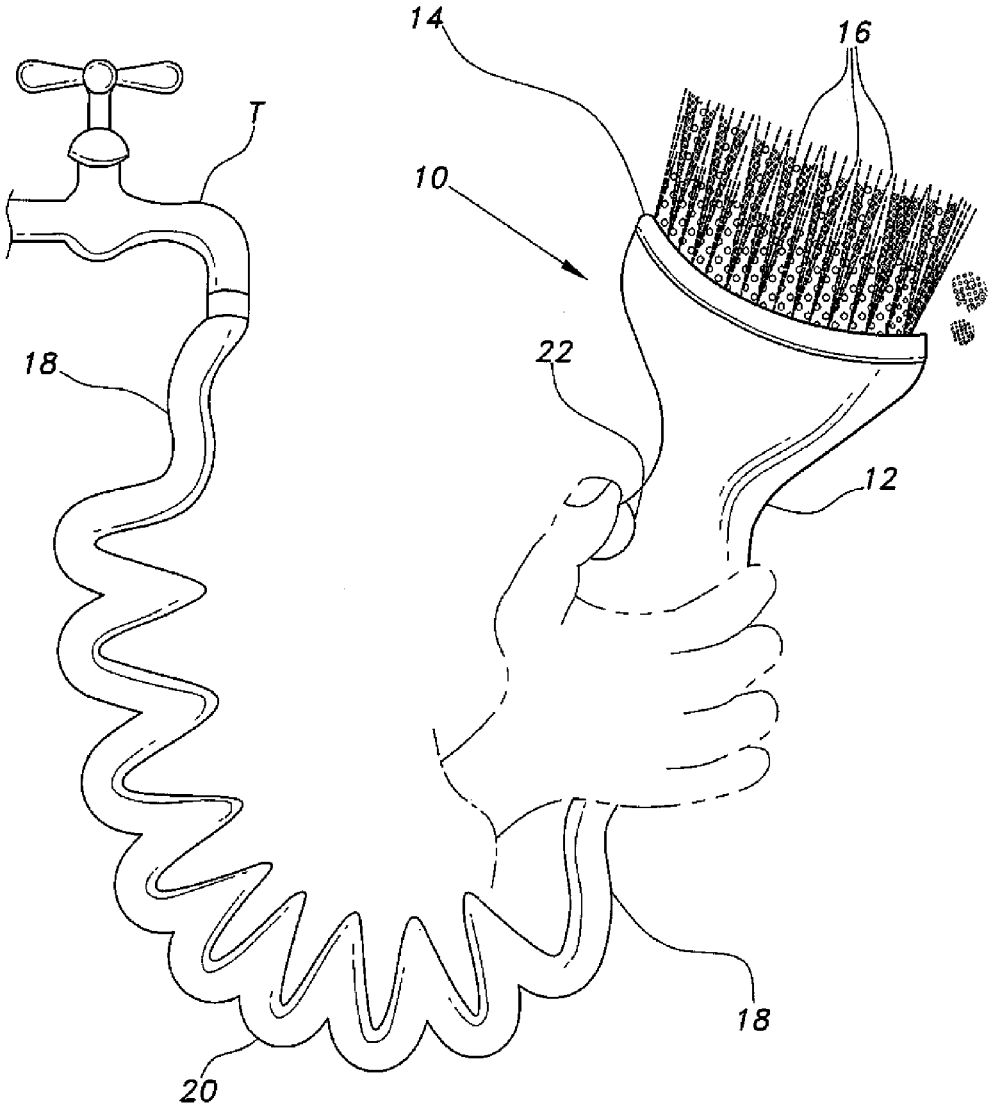
FIG. 1 is an environmental, perspective view of a liquid-dispensing shaving brush according to the present invention, illustrating various features thereof.

The liquid-dispensing shaving brush includes a number of different embodiments that provide for dispensing water through the head of the brush to moisten the face or skin of the user. FIG. 1 provides an environmental perspective view of a first embodiment of a liquid-dispensing shaving brush 10, wherein water is supplied from a remotely located water faucet or tap T. The liquid-dispensing shaving brush 10 includes a hollow handle portion 12 for the passage of water therethrough (or the storage of a volume of water therein, in certain embodiments) and a head 14 extending therefrom, the head 14 having a large number of flexible fibers or bristles 16 extending outwardly therefrom. Water passes from the tap T through a flexible water hose or line 18 to the handle portion 12 of the brush 10. The water hose or line 18 may include a flexible coiled portion 20 therealong, to provide a neater and more compact hose or line when unextended. Water flow through the brush 10 and out from the head 14 and through the bristles 16 may be controlled by a conventional control valve or mechanism 22 on one side of the handle portion 12.

Figure 2:
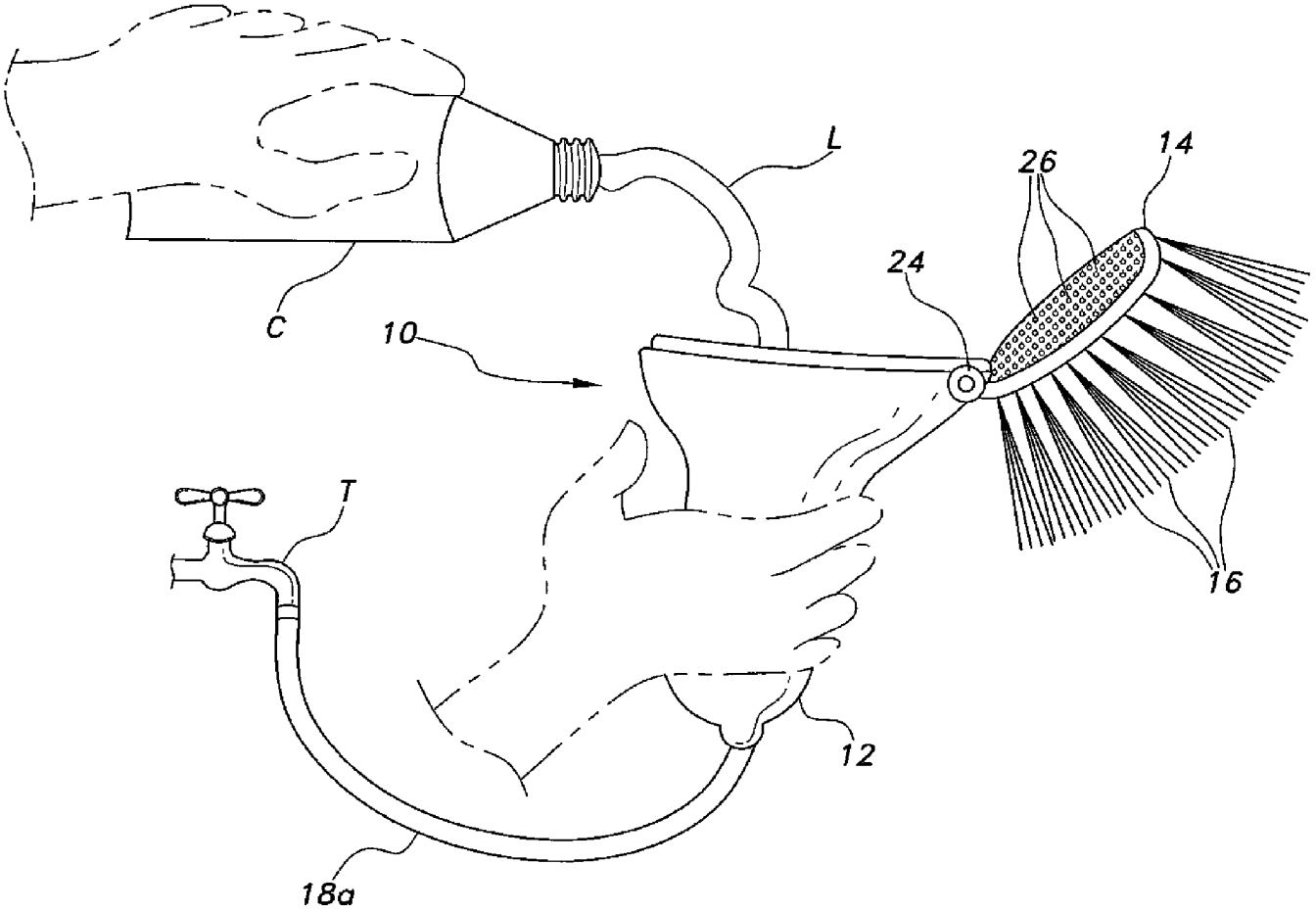
FIG. 2 is an environmental perspective view of an alternative embodiment of a liquid-dispensing shaving brush according to the present invention, illustrating the replenishment of a shaving soap or cream therein.

FIG. 2 illustrates another aspect of the liquid-dispensing shaving brush 10. It will be seen in FIG. 2 that the head 14 is attached to the upper or distal end of the handle portion 12 by a hinge 24, allowing the head 14 to be opened relative to the handle portion 12. This provides access to the hollow interior of the handle portion 12 to fill the handle portion with shaving cream or lather L from some other source, e.g., a tube or other container C. The water flow from the tap T passes through the water hose or line (the uncoiled line embodiment of FIG. 2 is designated as water hose or line 18*a*) to dilute the shaving lather L, which becomes entrained in the flow of water. The water and lather mixture then passes from the interior of the brush handle 12, out through a large number of fluid passages or pores 26 therein to pass through the bristles or fibers 16. Again, flow may be controlled by a control valve 22 (FIG. 1) disposed at some convenient location on the handle 12. The head 14 is closed to the upper or distal end of the handle 12 by a conventional latch mechanism (not shown).

Figure 3:
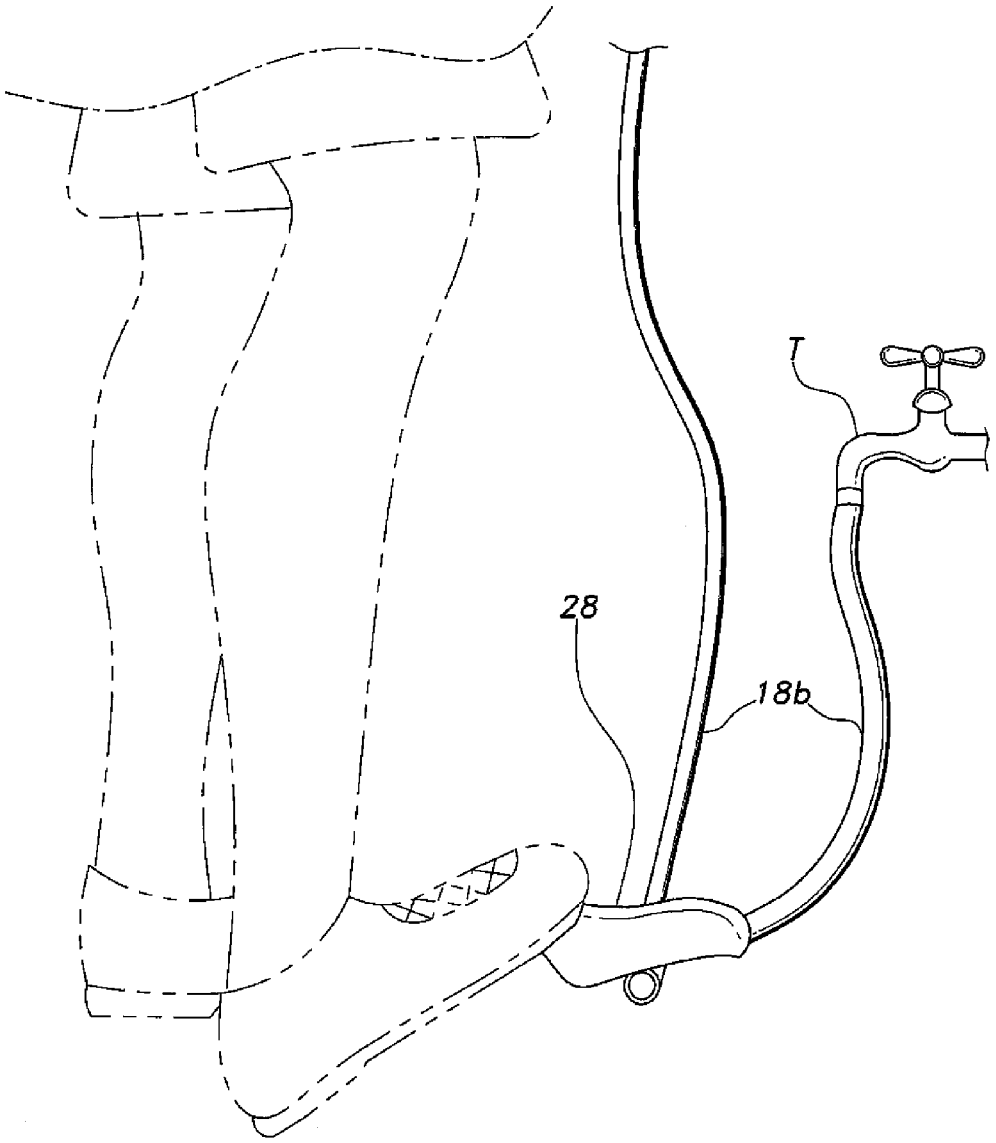
FIG. 3 is an environmental perspective view of an alternative embodiment of a liquid-dispensing control device for a water-dispensing shaving brush according to the present invention.

FIG. 3 of the drawings illustrates an alternative embodiment to the handle-mounted control valve 22 of the brush embodiment 10 of FIGS. 1 and 2. In FIG. 3, a foot-actuated water control valve 28 is installed in-line in the water supply hose or line 18*b*. The only difference between the uncoiled hose or line 18*a* of FIG. 2 and the hose or line 18*b* of FIG. 3 is the separation of the hose 18*b* into a first portion extending from the water source (e.g., tap T) to the control valve 22, and a second portion extending from the control valve 22 to the liquid-dispensing shaving brush. Such an arrangement may be used with a liquid-dispensing shaving brush embodiment that has no handle-mounted flow control valve, such as the brush 100 of FIG. 5.

Figure 4:
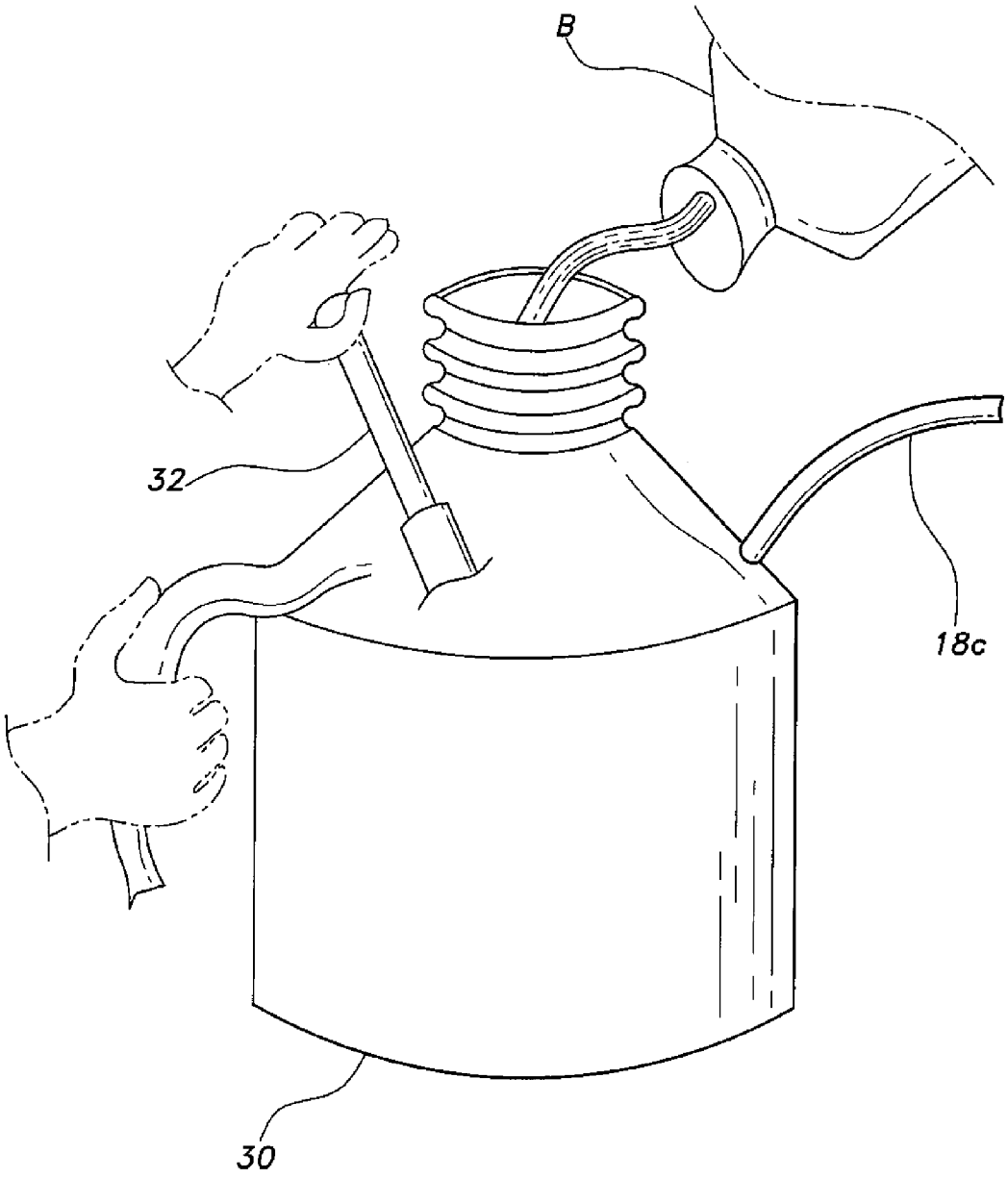
FIG. 4 is an environmental perspective view of alternative embodiment of a water source for a liquid-dispensing shaving brush according to the present invention.
Figure 5:
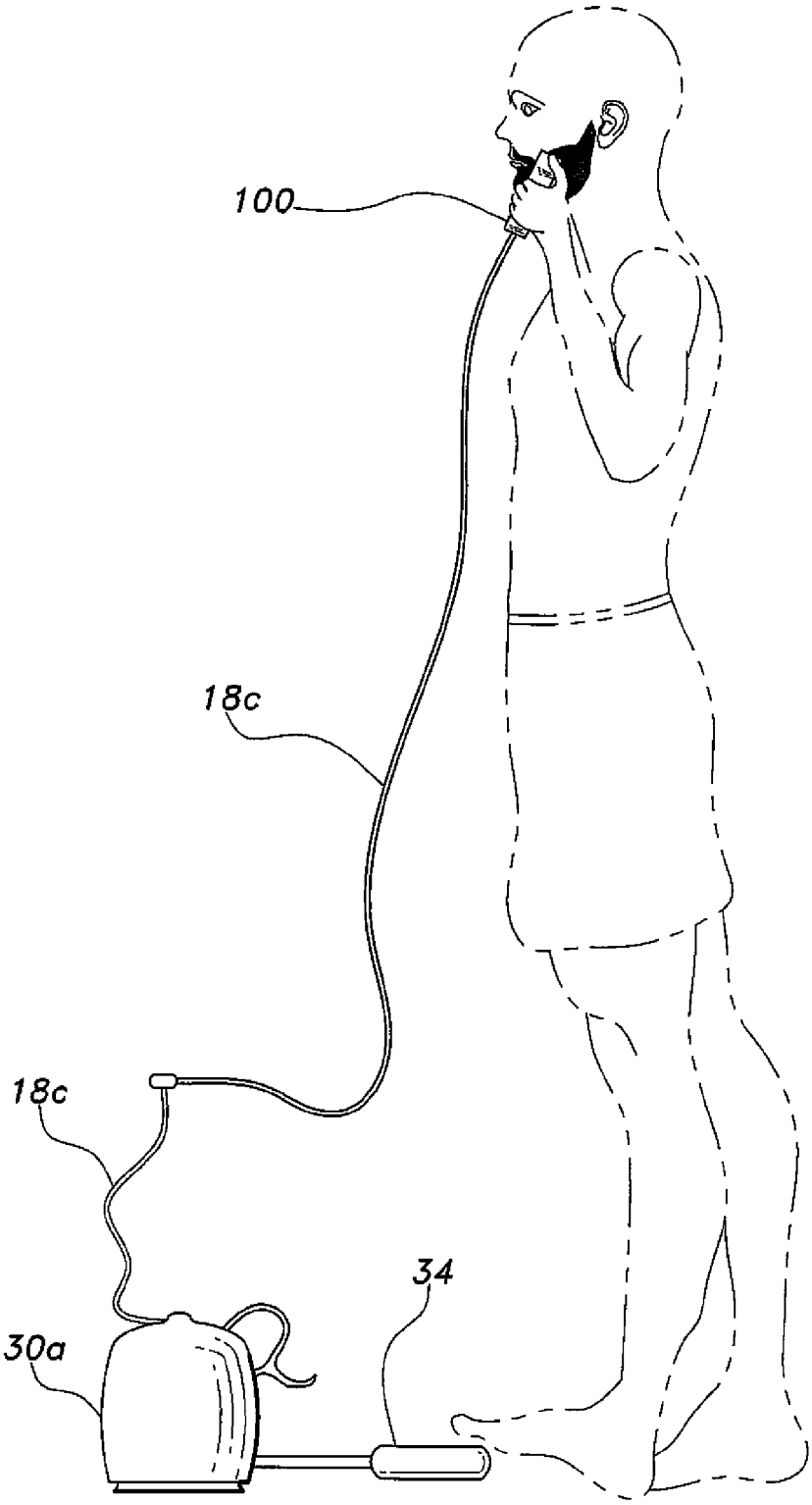
FIG. 5 is an environmental perspective view of another alternative embodiment of a water source for a liquid-dispensing shaving brush according to the present invention.

FIGS. 4 and 5 of the drawings illustrate an alternative embodiment that may be used when no source of continuous water flow is available. In FIG. 4 a portable water container 30 is provided. FIG. 4 illustrates filling the container 30 with water from another source, e.g., a bottle B or the like. The container 30 may also be filled with water from a remotely located tap or the like, and transported to the place of use. The container 30 includes a pneumatic pump 32 therewith, allowing the internal volume of the container 30 to be pressurized with air. It will be understood that the broken line illustration of the hand actuating the pump 30 is to illustrate the operation of the pump, and that the actual operation of the pump 30 would not be accomplished while the cap (not shown) is removed from the container 30 as shown in FIG. 4. A flexible water supply hose or line 18*c* is shown extending from the container 30 to provide water to the liquid-dispensing shaving brush, e.g., brush 10, if that brush is not connected to a water tap or other continuous supply of water, or to the brush 100 shown in FIG. 5.

In FIG. 5, a slightly different portable water container 30*b* is illustrated. The water container 30*b* includes a foot-actuated pump 34, rather than the hand pump 32 of the container 30 of FIG. 4. As the pneumatic pressure within the container 30*b* is controlled by the actuation of the pump 34, the pump 34 also serves as a water output control valve for the apparatus. The water supply line 18*c* from the container 30*a* may be connected to another similar line 18*c* extending from the liquid-dispensing shaving brush 100, or other liquid-dispensing shaving brush.

Figure 6:
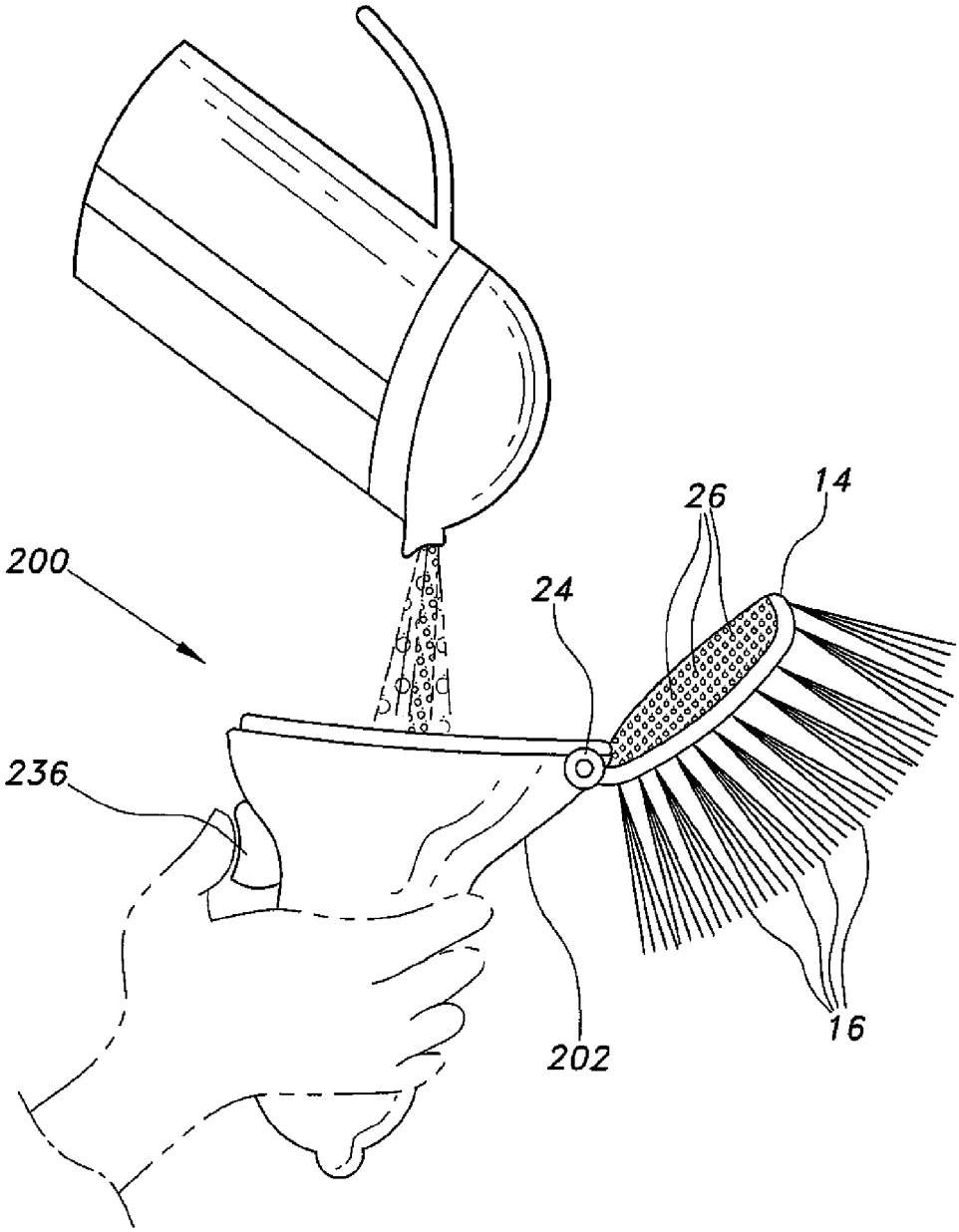
FIG. 6 is an environmental perspective view of another alternative embodiment of a liquid-dispensing shaving brush according to the present invention.

FIG. 6 provides an illustration of yet another embodiment of the liquid-dispensing shaving brush, designated as liquid dispensing shaving brush 200. The handle portion 202 of the brush 200 is devoid of any connection to an external or remote source of water, i.e., the tap T or water container 30 or 30*a* illustrated in previous drawings. However, the head 14, bristles or fibers 16, hinge attachment 24, and pores 26 defined the head 14 are substantially the same as those features or components of the liquid-dispensing shaving brush 10 of FIGS. 1 and 2. Rather than using a remote source of water, the hollow handle portion 202 is filled with water from any convenient source, e.g., the pitcher P shown in FIG. 6, etc., and the head 14 is closed over the upper or distal end of the handle portion 202. A pneumatic pressure pump control 236 disposed upon the handle at any suitable and convenient location thereon, is used to increase the air pressure within the handle portion 202 to force the water therein through the pores 26 in the head 14 of the brush, thereby wetting the bristles or fibers 16 of the head 14 to allow the user to moisten his face or skin. Thus, no remote source of water or pneumatic pressure is required with the liquid-dispensing shaving brush 200 of FIG. 6.

Figure 7:
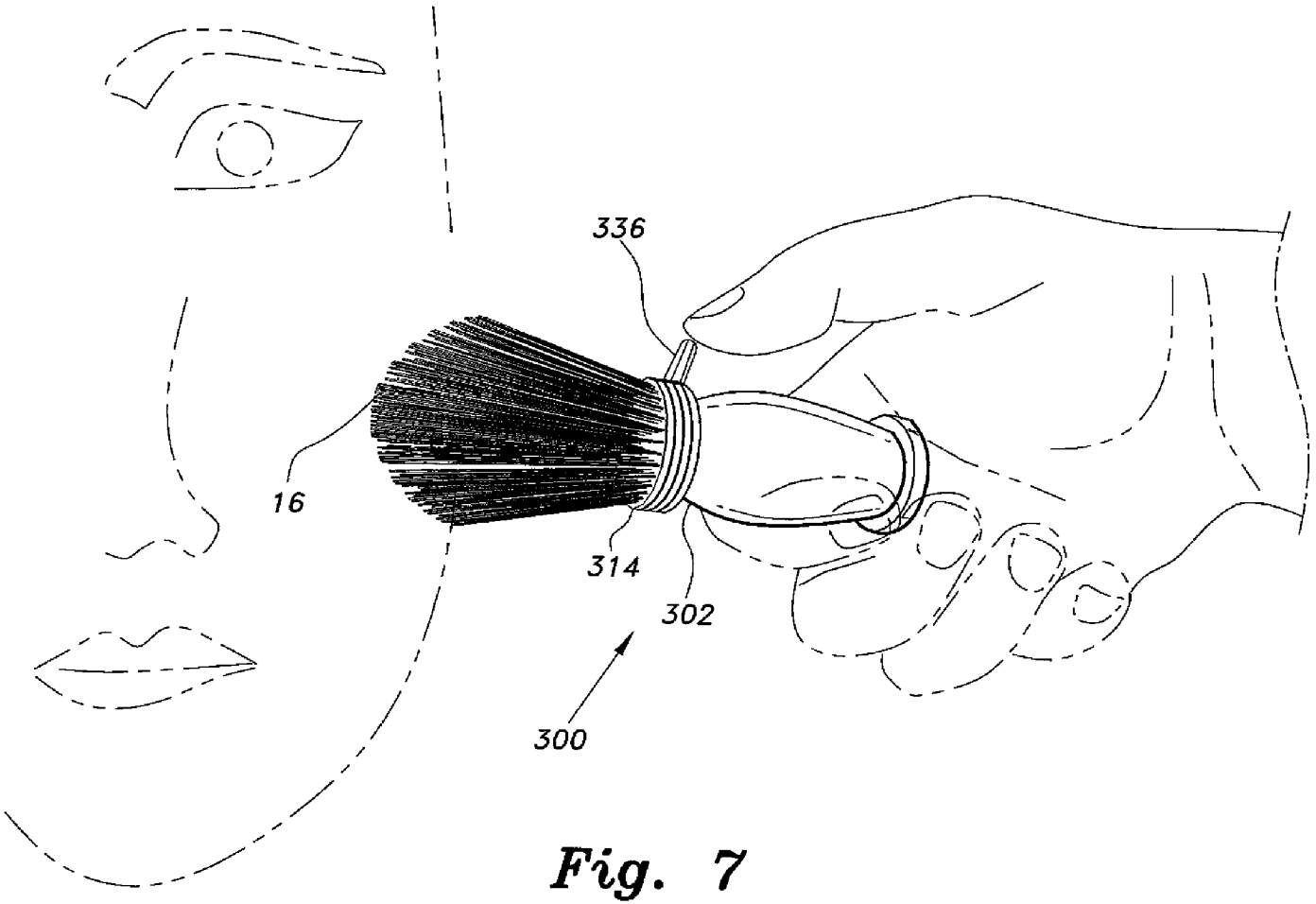
FIG. 7 is an environmental perspective view of another alternative embodiment of a liquid-dispensing shaving brush according to the present invention.
Figure 8:
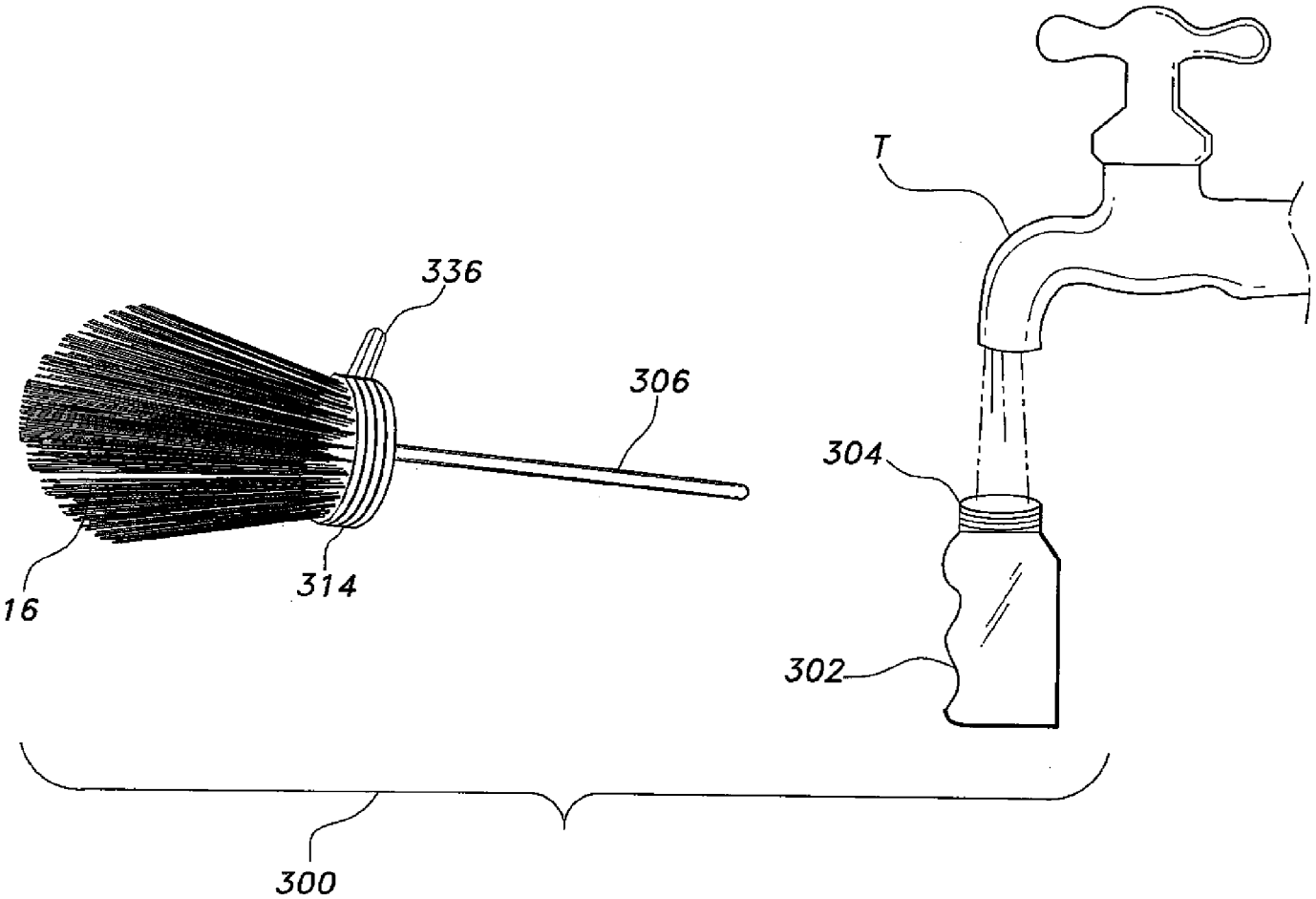
FIG. 8 is an exploded environmental perspective view of the liquid-dispensing shaving brush of FIG. 7, illustrating the filling of the hollow handle with water.

FIGS. 7 and 8 provide illustrations of yet another embodiment of the liquid-dispensing shaving brush, designated as liquid-dispensing shaving brush 300. The handle portion 302 of the brush 300 is devoid of any connection to an external or remote source of water, i.e., the tap T or water container 30 or 30*a* illustrated in various drawings. However, the head 314 differs from other embodiments in that it is threadably attached to the threaded neck 304 of the handle portion 302, rather than being pivotally attached. The bristles or fibers 16 and pores are substantially the same as those features or components of the liquid-dispensing shaving brush 10 of FIGS. 1 and 2. Rather than using a remote source of water, the hollow handle portion 302 is filled with water from any convenient source, e.g., the tap T shown in FIG. 8, and the head 314 is threaded onto the cooperatively threaded upper or distal end of the handle portion 302. A pneumatic pressure pump control 336 is disposed upon the handle at any suitable and convenient location thereon, and is used to increase the air pressure within the handle portion 302 to force the water therein through the pores in the head 314 of the brush, thereby wetting the bristles or fibers 16 of the head 314 to allow the user to moisten his face or skin. A pickup tube 306 is provided to extend from the head 314 to the opposite end of the hollow handle 320 to draw water or other liquid from the base of the handle. Thus, no remote source of water or pneumatic pressure is required with the liquid-dispensing shaving brush 300 of FIGS. 7 and 8.

Figure 9:
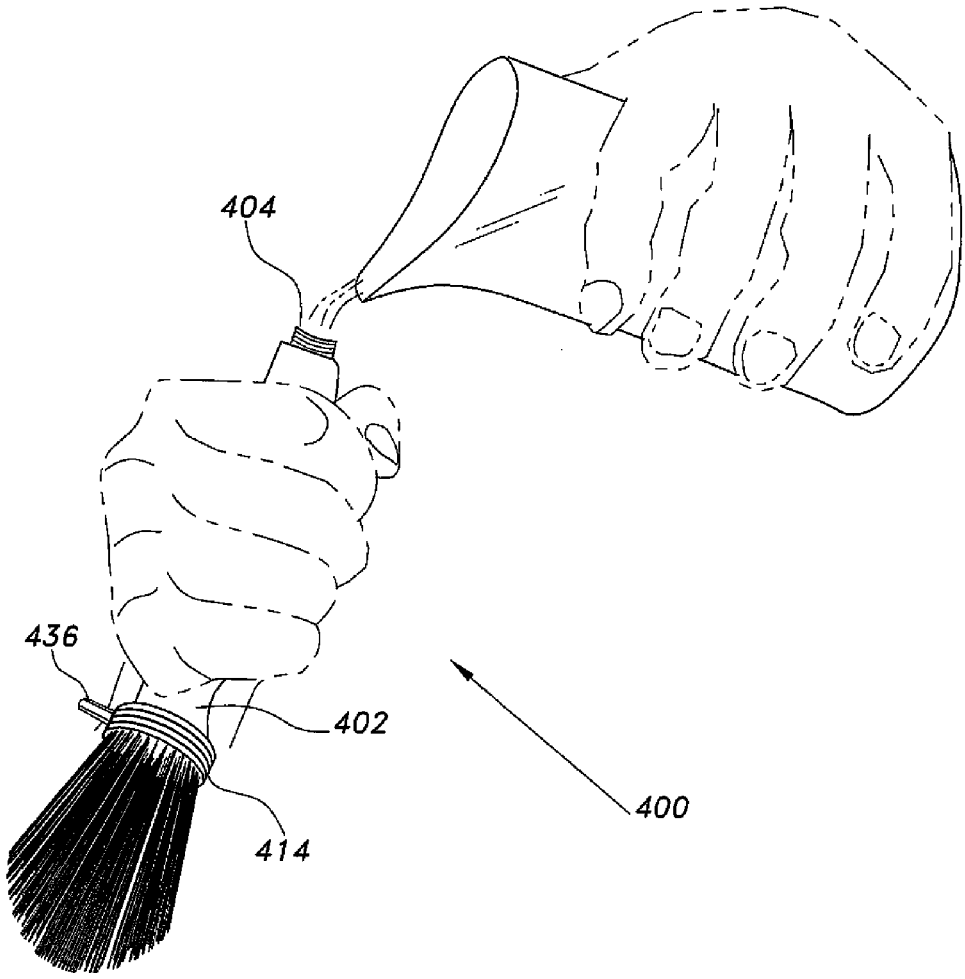
FIG. 9 is an environmental perspective view of another alternative embodiment of a liquid-dispensing shaving brush according to the present invention.

FIG. 9 provides an illustration of yet another embodiment of the liquid-dispensing shaving brush, designated as liquid-dispensing shaving brush 400. The brush 400 of FIG. 9 is substantially the same as the brush 300 of FIGS. 7 and 8, having a handle portion 402 and a porous head 414, bristles 16, and pneumatic pump 436. The only basic difference between the brush 300 and the brush 400 is that the filler neck 404 is located at the base of the handle and is accessed by a separate cap (not shown), rather than by removing the threaded head 314 from the handle portion 302, as in the embodiment 300 of FIGS. 7 and 8. Operation is substantially the same for the brush 400 as for the brush 300 once the cap has been installed upon the filler neck 404 at the base of the handle 402.

Figure 10:
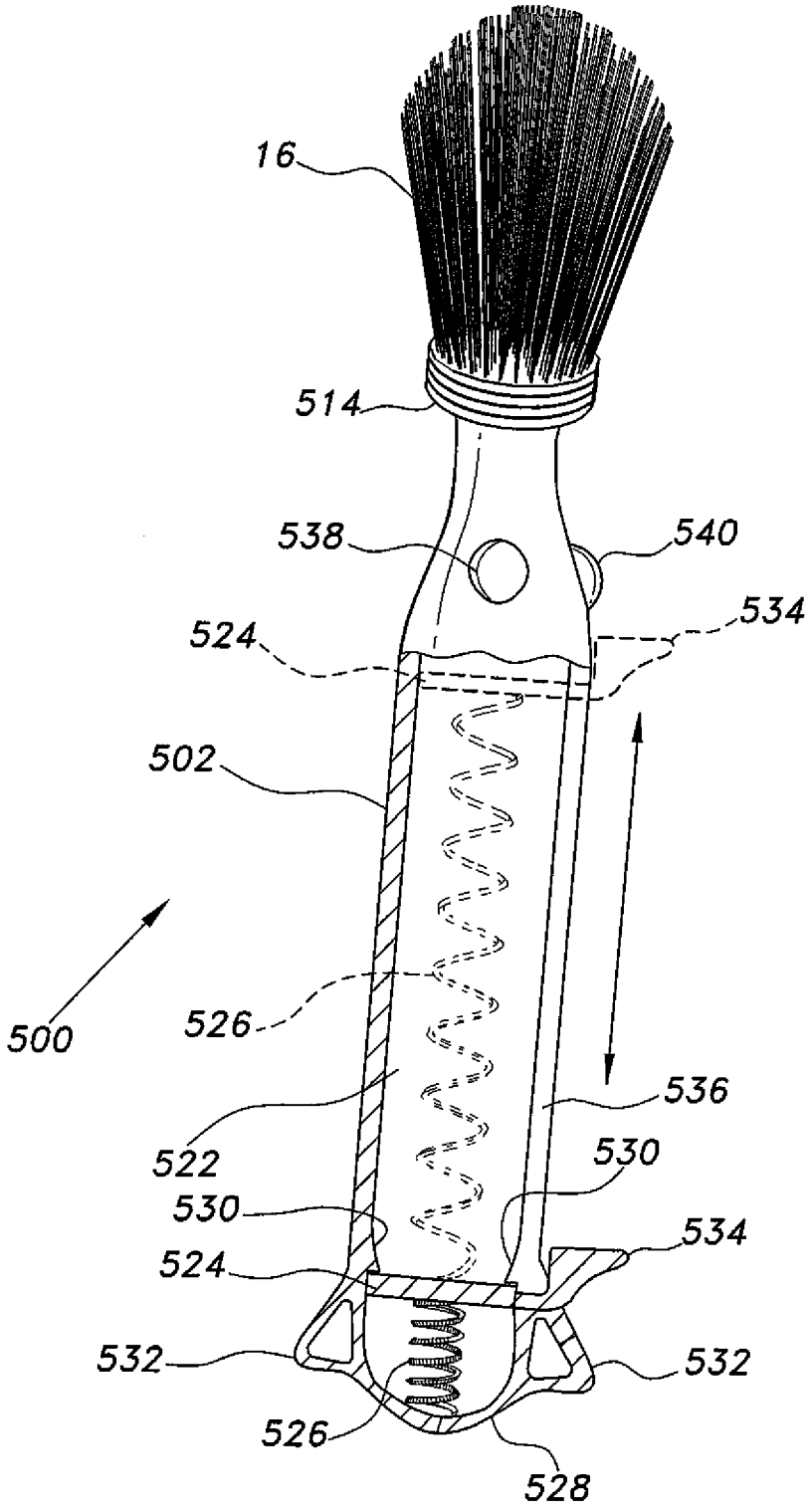
FIG. 10 is a perspective view of another alternative embodiment of a liquid-dispensing shaving brush according to the present invention, shown with the handle broken away and in partial section, wherein the handle of the brush contains a spring-actuated dispenser.

FIG. 10 provides an illustration of yet another embodiment of a liquid-dispensing shaving brush, designated as liquid-dispensing shaving brush 500. Certain aspects of the brush 500 of FIG. 10 are similar to those of the brushes 300 and 400 of FIGS. 7 through 9, having a hollow handle portion 502, a porous head 514, and bristles 16.

The hollow handle 502 includes an internal liquid storage cavity 522 therein. A plunger 524 of elastomer or other suitable material is slidingly disposed within the handle storage cavity 522, the edges of the plunger 524 making a good seal with the internal walls of the hollow handle 502. A spring 526 is seated in the distal end 528 of the hollow handle 502 and compressively urges the plunger 524 through the storage cavity 522 toward the head 514 of the shaving brush 500. The plunger 524 may be retained near the distal end 528 of the handle 502 by latches 530 extending inwardly from the inner walls of the hollow handle 502 near the distal end 528 thereof. The latches 530 may be selectively released by pressure on the external tabs 532 that extend from the handle 502 near the distal end 528 thereof, thereby allowing the spring 526 to push the plunger 524 through the internal cavity 522 of the handle 502 to expel any fluid therein from the pores of the brush head. (The pores are essentially the same as the fluid passages 26 illustrated in the embodiments 10 and 200 respectively of FIGS. 2 and 6.) A retraction lever 534 extends from the edge of the plunger 524, the extension or connection between the plunger 524 and lever 534 traveling in a slot 536 formed along the side of the handle 502.

The liquid-dispensing shaving brush 500 is used by first retracting the spring 526 and plunger 524 by means of the retraction lever 534 and capturing the plunger 524 with the internal latches 530 to maximize the internal volume 522 of the handle 502 between the plunger 524 and the shank portion 516. A filler port and cap 538 for filling the handle 502 is provided at the juncture of the handle 502 and head 514. The cap 538 is removed and the internal volume 522 of the handle 502 is filled with shaving cream, foam, gel, or other liquid. The cap 538 is then replaced, and the plunger 524 is released by manipulating the external release tabs 532 adjacent the distal end 528 of the handle 502 to pressurize the contents of the handle 502 by means of the spring 526 and plunger 524. A dispensing control valve 540 of conventional configuration is provided at the juncture of the handle 502 and shank 516. Operation of the valve 540 opens the passage from the internal volume 522 of the handle 502 through the shank 516 to the dispensing pores of the brush head 514, thereby dispensing the liquid from the pores as the spring 526 and plunger 524 urge the liquid within the internal volume 522 of the handle 502 toward the brush head 512.

Figure 11:
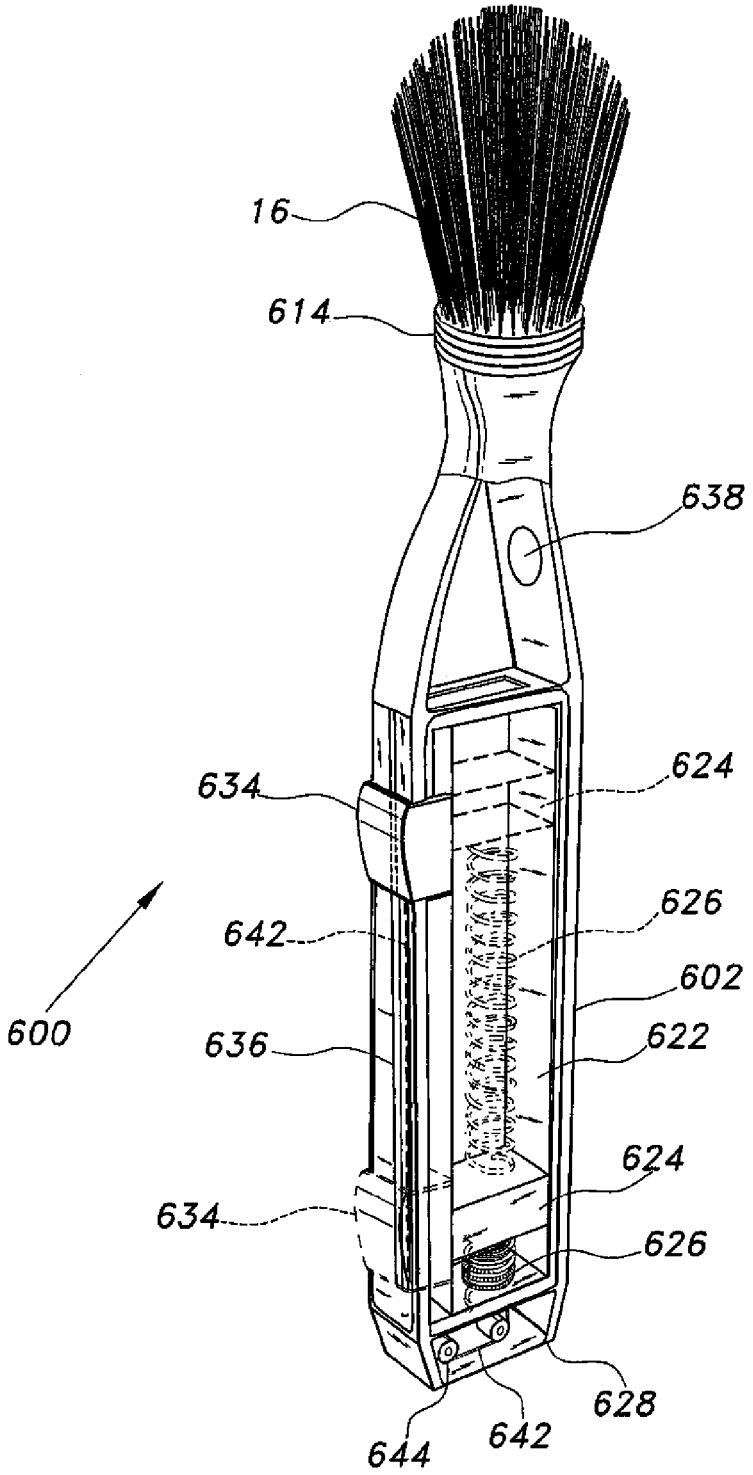
FIG. 11 is a perspective view of another alternative embodiment of a liquid-dispensing shaving brush according to the present invention, shown with a portion of the handle removed to show details thereof, wherein the handle of the brush contains another embodiment of the spring-actuated dispenser.

FIG. 11 provides an illustration of a further embodiment of a liquid-dispensing shaving brush, comprising a shaving brush 600 having a hollow handle for the containment of water, shaving cream, and/or other liquid. The shaving brush 600 includes a porous head 614 having a brush or bristles 16 extending therefrom and a hollow handle portion 602 extending from the head 614 opposite the bristles.

The liquid-dispensing shaving brush 600 includes a hollow handle portion 602 extending from the head 614, as noted above. The handle 602 includes an internal liquid storage cavity 622 therein. A plunger 624 of elastomer or other suitable material is slidingly disposed within the handle storage cavity 622, the edges of the plunger 624 making a good seal with the internal walls of the hollow handle 602. A spring 626 is seated in the distal end 628 of the hollow handle 602, and compressively urges the plunger 624 through the storage cavity 622 toward the head 614 of the shaving brush 600.

The dispensing mechanism of the shaving brush 600 differs from that of the shaving brush 500 in that the lever or slide 634 along the side of the handle 602 is not directly connected to the plunger 624 within the handle. The slide or lever 634 rides or slides in a slot 636 through the side of the handle 602 and is connected to a cable, cord, or the like 642 that extends toward the distal end 628 of the handle to pass around a pair of rollers or pulleys 644 disposed within the distal end 628 of the handle, thence continuing up to attach to the bottom of the plunger 624, i.e., to the same side of the plunger that bears against the spring 626. The at-rest positions of the plunger 624 and slide or lever 634 are shown in broken lines in FIG. 11, the compressive spring 626 also being shown in broken lines in its fully extended state.

The shaving brush 600 is used by first retracting the spring 626 and plunger 624 by sliding the slide or lever 634 from its rest position near the distal end 628 of the handle 602 to its position as shown in solid lines near the shank 616 of the shaving brush 600. This draws the cable or cord 642 upward along the slot 636, thereby drawing the cable 642 around the rollers or pulleys 644 to draw the plunger 624 to a position shown in solid lines toward the distal end 628 of the handle 602, thereby compressing the spring 626, as shown in solid lines in FIG. 11. The internal volume 622 of the handle 602 may then be filled with shaving cream, foam, gel, or other liquid through the cap 638. The cap 638 is then replaced, and the plunger 624 is released by releasing the slide or lever 634 from its position shown in broken lines to allow the spring to push the plunger 624 toward the shaving brush head 614, thereby forcing the liquid contained within the handle 602 up through the shank 616 and brush head 614 and out through the pores of the shaving brush head 614 to moisten the beard of the user of the shaving brush 600.

Figure 12:
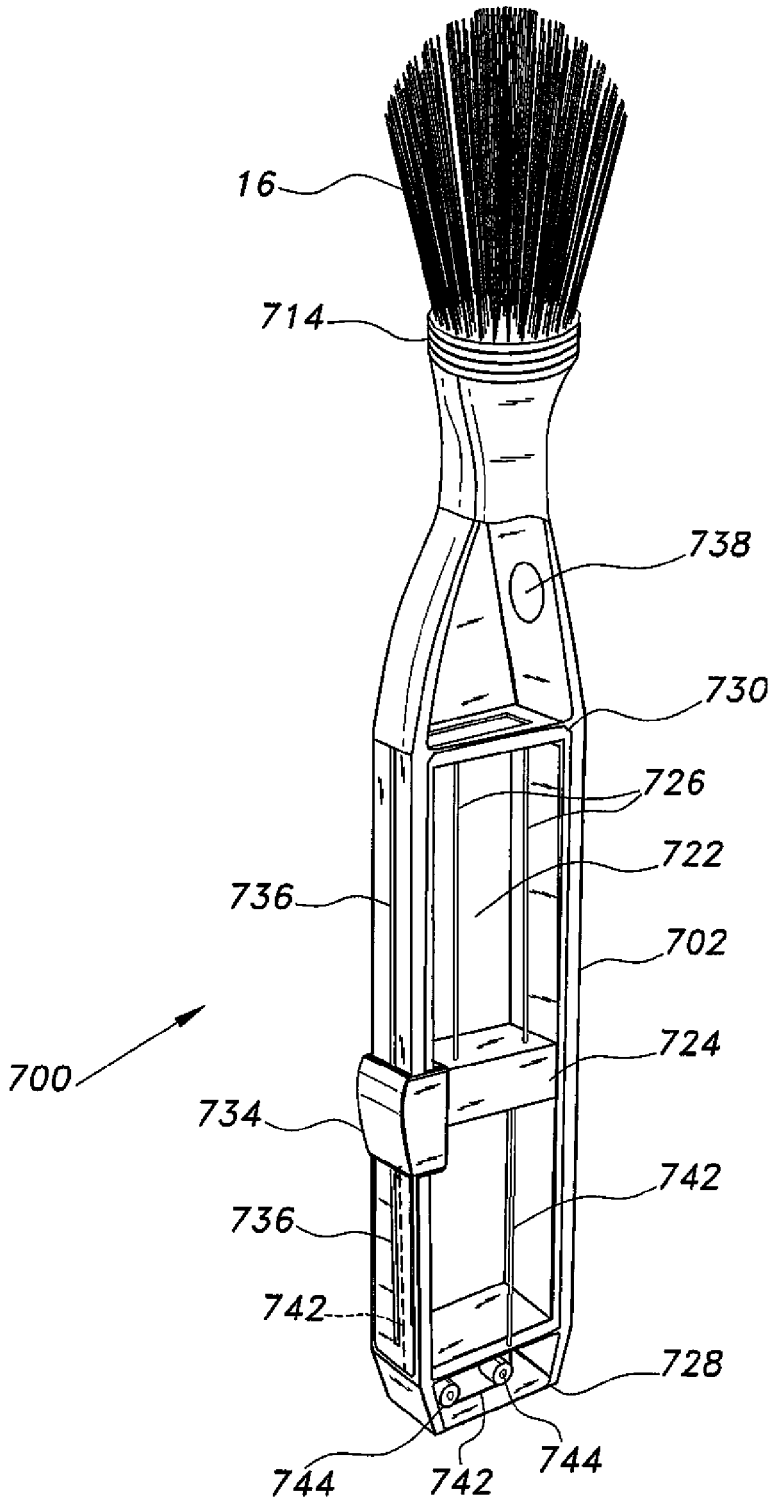
FIG. 12 is a perspective view in partial section of another alternative embodiment of a liquid-dispensing shaving brush according to the present invention, shown with a portion of the handle removed to show details thereof, wherein the handle of the brush contains an elastomer cord-actuated dispenser.

FIG. 12 provides an illustration of a further embodiment of a liquid-dispensing shaving brush, comprising a shaving brush 700 having a hollow handle for the containment of water, shaving cream, and/or other liquid. The shaving brush 700 includes a porous head 714 having a brush or bristles 16 extending therefrom and a hollow handle portion 702 extending from the head 714 opposite the bristles.

The shaving brush 700 includes a hollow handle portion 702 extending from the head 714. The handle 702 includes an internal liquid storage cavity 722 therein. A plunger 724 of elastomer or other suitable material is slidingly disposed within the handle storage cavity 722, the edges of the plunger 724 making a good seal with the internal walls of the hollow handle 702. One or more elastic bands or cords 726 extend from the plunger 724 to the upper end 730 of the hollow cavity or chamber 722 and draw the plunger 724 through the storage cavity 722 toward the head 714 of the shaving brush 700.

The dispensing mechanism of the shaving brush 700 differs from that of the brush 600. Rather than using a compressive spring, the brush 700 uses one or more elastomer bands or cords in tension. The slide or lever 734 rides or slides in a slot 736 through the side of the handle 702, and is connected to a cable, cord, or the like 742 that extends toward the distal end 728 of the handle to pass around a pair of rollers or pulleys 744 disposed within the distal end 728 of the handle, thence continuing up to attach to the bottom of the plunger 724, i.e., to the opposite side of the plunger from that connected to the elastomer cord(s) 726.

The shaving brush 700 is used by first extending the elastomer cord(s) 726 and drawing the plunger 724 toward the distal end 728 of the handle 702 by sliding the slide or lever 734 from its rest position near the distal end 728 of the handle 702 to a position nearer the head 714 of the brush 700. (The slide or lever 734 and plunger 724 are illustrated at an intermediate position in FIG. 12.) This draws the cable or cord 742 upward along the slot 736, thereby drawing the cable 742 around the rollers or pulleys 744 to draw the plunger 724 toward the distal end 728 of the handle 702, thereby extending the elastomer cord(s) 726. The internal volume 722 of the handle 702 may then be filled with shaving cream, foam, gel, or other liquid through the cap 738. The cap 738 is then replaced, and the plunger 724 is released by releasing the slide or lever 734 from its position shown in broken lines to allow the elastomer cord(s) 726 to draw the plunger 724 toward the shaving brush head 714, thereby forcing the liquid contained within the handle 702 up through the upper end 730 of the hollow handle cavity 722 and shaving brush head 714 and out through the pores (as shown in FIGS. 2 and 6) of the shaving brush head 714 to moisten the beard of the user of the shaving brush 700.

Figure 13:
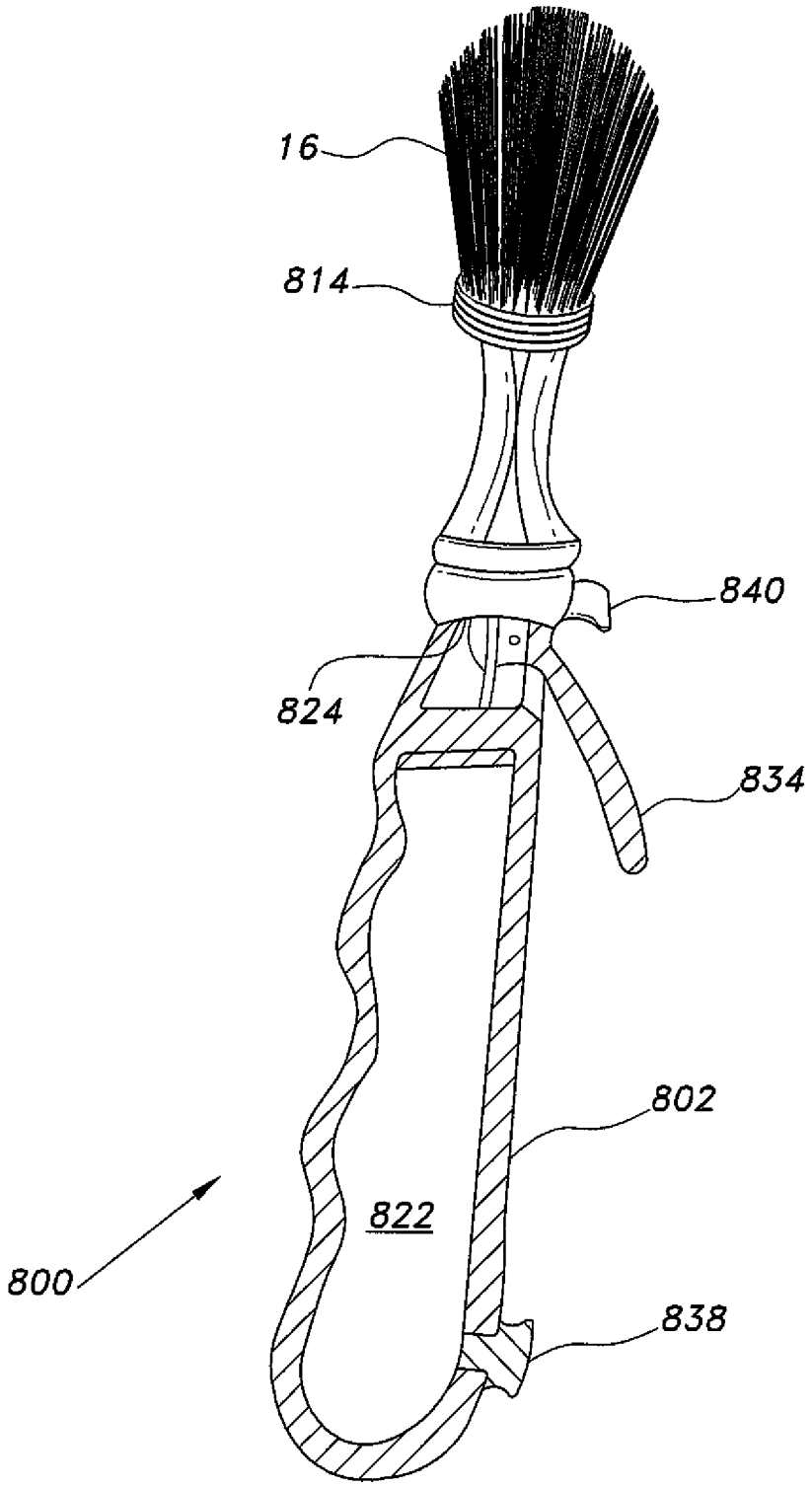
FIG. 13 is a perspective view of another alternative embodiment of a liquid-dispensing shaving brush according to the present invention, shown broken away and in partial section, wherein the handle of the brush contains another embodiment of a mechanically actuated dispenser.

FIG. 13 provides an illustration of a further embodiment of a liquid-dispensing shaving brush, comprising a shaving brush 800 having a hollow handle for the containment of water, shaving cream, and/or other liquid. The shaving brush 800 includes a porous head having a brush or bristles 16 extending therefrom and a hollow handle portion 802 extending from the head 814 opposite the bristles.

The liquid-dispensing shaving brush 800 includes a hollow handle portion 802 attached to the head 814 via intermediate structure. The handle 802 includes an internal liquid storage cavity 822 therein. Rather than using a plunger and other mechanism to urge or force liquid within the handle up toward the brush head, the shaving brush 800 uses a small manually operated pneumatic pump 824 of conventional mechanism to pressurize the interior volume 822 of the handle 802. The pump 824 may be operated by using the thumb or finger to operate a lever 834. Prior to pressurizing the internal volume 822 of the handle 802, the internal volume 822 of the handle 802 may be filled with shaving cream, foam, gel, or other liquid through the cap (not shown in FIG. 13, but similar to, e.g., the cap 538 of the shaving brush embodiment 500 of FIG. 10). The cap is then replaced, and the pump 824 is actuated by means of the lever 834, thereby pressurizing the interior volume 822 of the handle 802 and forcing the liquid contained within the handle 802 up to the shaving brush head 814 and out through the pores (as shown in FIGS. 2 and 6) of the shaving brush head 814 to moisten the beard of the user of the shaving brush 800. Control of the amount of liquid dispensed is provided by means of a dispensing control valve 840 of conventional configuration disposed at the pump 824, at the juncture of the handle 802 and structure joining the handle portion 802 to the head 814. The control valve 840 may be of similar configuration to that of the valve 540 of the shaving brush 500 of FIG. 10.

It is to be understood that the present invention is not limited to the embodiments described above, but encompasses any and all embodiments within the scope of the following claims.

I claim:

1. A liquid-dispensing shaving brush, comprising:

a hollow handle;

a head having a plurality of fluid passages disposed therethrough;

a hinge pivotally attaching the head to the handle, whereby the handle may be loaded with shaving lather for dispensing through the fluid passages in the head;

a plurality of bristles extending from the head; and a flexible water line adapted for connecting the handle to a water supply.

2. The liquid-dispensing shaving brush according to claim 1, wherein a portion of the flexible water line is coiled.

3. The liquid-dispensing shaving brush according to claim 1, further comprising a foot-actuated control valve disposed in the water line, the valve having an open position permitting water to flow through the water line and a closed position blocking the flow of water through the water line.

4. The liquid-dispensing shaving brush according to claim 1, further comprising a portable water container connected to the water line, the container being adapted for holding a supply of water.

5. The liquid-dispensing shaving brush according to claim 4, further comprising a water control valve mounted on the portable water container.

6. The liquid-dispensing shaving brush according to claim 1, further comprising a pressure pump control disposed upon the handle.

* * * * *